US007712685B2

(12) United States Patent
Lehtonen

(10) Patent No.: US 7,712,685 B2
(45) Date of Patent: May 11, 2010

(54) DEVICE FOR FUEL INJECTION RATE SHAPING

(75) Inventor: Kai Lehtonen, Vaasa (FI)

(73) Assignee: Wärtsilä Finland Oy, Vaasa (FI)

( * ) Notice: Subject to any disclaimer, the term of this patent is extended or adjusted under 35 U.S.C. 154(b) by 880 days.

(21) Appl. No.: 10/596,963

(22) PCT Filed: Dec. 31, 2004

(86) PCT No.: PCT/FI2004/000812

§ 371 (c)(1),
(2), (4) Date: Jun. 30, 2006

(87) PCT Pub. No.: WO2005/071251

PCT Pub. Date: Aug. 4, 2005

(65) Prior Publication Data

US 2007/0102536 A1 May 10, 2007

(30) Foreign Application Priority Data

Jan. 23, 2004 (FI) ..... 20040099

(51) Int. Cl.
*F02M 45/00* (2006.01)

(52) U.S. Cl. ..... 239/533.5; 239/570; 123/496

(58) Field of Classification Search ..... 239/88–95, 239/570–574, 533.3–533.12; 137/494, 543.15, 137/514.5; 123/446–447, 496, 500–501
See application file for complete search history.

(56) References Cited

U.S. PATENT DOCUMENTS 3,392,715 A 7/1968 Thoma
3,399,692 A * 9/1968 Hebert ..... 137/492.5
4,811,899 A 3/1989 Egler
5,645,224 A * 7/1997 Koch ..... 239/533.4
6,899,088 B2 * 5/2005 Djordjevic ..... 123/510
2003/0111548 A1 6/2003 Buck

FOREIGN PATENT DOCUMENTS

EP 0 855 504 7/1998
JP 2003184705 A 7/2003
WO WO02/14685 * 2/2002
WO 2004/111440 12/2004

OTHER PUBLICATIONS

Norio Nakamura, Japanese Office Action for JP 2006-550202 (English translation), Sep. 15, 2009.

* cited by examiner

*Primary Examiner*—Christopher S Kim
(74) *Attorney, Agent, or Firm*—Chernoff, Vilhauer, McClung & Stenzel

(57) ABSTRACT

The present invention relates to fuel injection in internal combustion engines and to fuel rate shaping. Especially, the invention relates to combustion engines utilizing heavy fuel oil as a fuel. In the body of the device there is arranged a chamber, in which a movable piston is arranged dividing the chamber into a first main volume and a second main volume, the volumes of which depend upon the position of the piston. Moreover, the device comprises at least one auxiliary volume, which can be united with the main volumes. The auxiliary volume can be filled with the fuel entering the device through the first main volume by utilizing the piston motion. By establishing a connection from the auxiliary volume to the second main volume a fuel flow to the second main volume is allowed.

11 Claims, 5 Drawing Sheets

DEVICE FOR FUEL INJECTION RATE SHAPING

This is a national stage application filed under 35 USC 371 based on International Application No. PCT/FI2004/000812 filed Dec. 31, 2004, and claims priority under 35 USC 119 of Finnish Patent Application No. 20040099 filed Jan. 23, 2004.

FIELD OF INVENTION

The present invention relates to fuel injection in internal combustion engines and to fuel rate shaping. Especially, the invention relates to internal combustion engines utilising heavy fuel oil as a fuel.

Prior Art

It has been conventional to use a valve in connection with the fuel pump for internal combustion engines, which valve provides a convenient fuel flow to the feed line of the nozzle. The publication U.S. Pat. No. 2,612,841 discloses such a traditional arrangement. In technical solutions of this kind the secondary feed of the nozzle, i.e. detrimental leakage, to the combustion space has been prevented.

It is also known to control the fuel pressure within the supply line of the nozzle, whereby the purpose is to maintain a pressure suitable for the nozzle operation within the supply line in various steps of the combustion process. The publication EP 855504 A1 discloses an example of such a solution.

The pressure and quantity of the fuel supplied into the nozzle has also significance for the quantity and quality of the combustion gases generated by the combustion process, which gases load the environment. Therefore, the aim has been to control the fuel flow rate and pressure within the feed line by means of various, relatively complicated, electronic systems.

Further, it is known to use a flow fuse as a safety device in injection systems of common rail type. The flow fuse is usually disposed between a pressure accumulator and an injection valve. The flow fuse blocks the flow path out of the accumulator in the event of leakage and should the injection valve get stuck in the open position.

In a typical common rail system the injection pressure reaches a high pressure level almost immediately when the needle starts rising in the nozzle. Consequently, fuel is injected into the combustion space so that the mass flow is extremely voluminous from the very start of the injection. In this case, the cylinder pressure may rise too fast for achieving an optimum performance. Thus, the maximum pressure shown by the injection pressure curve (the pressure in the nozzle at various moments of time during the injection process) is generally reached too early. In addition, the reduction of the injection pressure takes time before the start of next injection.

A purpose of the present invention is to eliminate/diminish said problems related to prior art by means of a simple and reliable construction. The purpose is achieved as is described in the claims.

BRIEF DESCRIPTION OF THE INVENTION

In the technical solution according to the invention it is possible to shape the injection rate in a desired manner. The idea is that the device has at least one volume, an auxiliary volume 16, into which the flow is restricted from a first main volume 4 at the start of the injection. In the beginning of the injection the restricted fuel flow passes merely through a clearance (between a piston 5 of the device and a smaller piston 6) or through a separate choking (not shown in the figure) and a clearance. The restricted flow and the increase the volume of the auxiliary volume 16 due to the motion of the piston 5 cause a pressure drop in the auxiliary volume 16. At the same time, due to the injection, the pressure falls in a second main volume 11 according to the invention compared to that in the first main volume 4.

In a later step of the injection process, when the piston 5 has passed a certain point, the flow into the auxiliary volume 16 is no longer restricted, whereby the pressure prevailing therein is almost the same as that in the first main volume 4. Then also in the second main volume 11 the pressure is almost the same as in the first main volume. After the termination of the injection the piston starts its return motion. The speed of the return motion is primarily determined by the area of the through-drilled choking 7 in the smaller piston 6 and by the pressure of a spring 9 pressing the piston 5. When the return motion of the piston reaches a certain point, the flow from the auxiliary volume 16 to the first main volume 4 is restricted. Consequently, the piston motion is normally slowed down, but as the smaller piston 6 is allowed to move and open a flow path from the auxiliary volume 16 to the second main volume 11, the speed of the piston is not reduced, but actually increased.

It is advantageous to dispose the device according to the invention between the pressure accumulator of the internal combustion engine and the valve guiding the injection, i.e. the injection valve, when such an embodiment of the invention is applied, where the flow from an inlet channel 103 of the device to an outlet channel 1012 is interrupted, if the piston 105 performs a full stroke. It is also advantageous to dispose the device according to the invention between the valve guiding the injection, and the nozzle, when such an embodiment of the invention is used, where the flow from an inlet channel 3 to an outlet channel 12 is not interrupted despite of the piston 5 performing a full stroke.

The basic embodiment of the device according to the invention comprises a body, in which a chamber is arranged, a first channel at the first end of the device for the fuel primarily entering the device and a second channel at the second end of the device for the fuel primarily leaving the device. The first and second channel are in communication with the chamber, in which a movable piston is arranged dividing the chamber into a first and second main volume, the volumes of which depend upon the position of the piston. Further, the device comprises at least one auxiliary volume, which can be united with the main volumes.

The auxiliary volume can be filled with the fuel entering the device through the first main volume by utilising the piston motion in the first direction (the piston motion when the injection commences). By utilising the piston motion in the second direction (the piston motion after the injection has been terminated) a desired pressure can be reached within the auxiliary volume for the fuel therein. By establishing a connection from the auxiliary volume to the second main volume, a fuel flow from the auxiliary volume to the second main volume is allowed, whereby the piston motion in the second direction is speeded up. It is to be noticed that the aim with the connection established between the auxiliary volume and the second main volume is not to restrict. the fuel flow. In addition, said filling of the auxiliary volume with fuel slows down the pressure increase at the start of the injection process transferring the maximum pressure to a later moment of time.

The invention also relates to a method for providing the operation according to the invention. In the method the auxiliary volume is filled with the fuel entering the device through the first main volume by utilising the piston motion in the first direction, a sufficient pressure is provided in the auxiliary volume by the piston motion in the second direction and a connection from the auxiliary volume to the second main volume is established for speeding up the piston motion in the second direction, whereby a fuel flow from the auxiliary volume to the second main volume is allowed.

LIST OF DRAWINGS

In the following the invention is described with reference to the attached drawings, in which FIGS. 1-9 show an example of an embodiment according to the invention in its various operating states;

DESCRIPTION OF THE INVENTION

Figure 1:
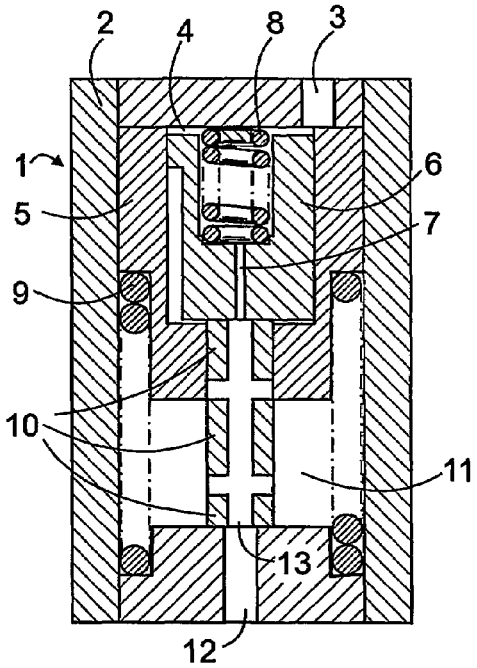

FIGS. 1-9 show an example of an embodiment 1 according to the invention in its various operating states. The body 2 of the device according to the figures defines a chamber, with which a first channel 3 of the device, i.e. the inlet channel for fuel, and a second channel 12, i.e. the outlet channel for fuel, are connected. Within the chamber a first piston 5 and a second piston 6 of the device are arranged. A first resilient means 9 biases the first piston 5 toward the first end of the device, where the first channel 3 is located.

Both the first piston 5 and the second piston 6 are cup-shaped comprising a cup. If the cross-section of the body of the device is circular, then also the cross-section of the first piston is a circle, whereby it in its simplest form is a cylindrical piece, in which a recess (a recess for the cup) is bored. The second piston 6 is located in the recess, i.e. in the cup, of the first piston 5. The cups of both pistons open toward the first end of the device.

The outer edges of the first piston 5 abut onto the body 2 of the device. Moreover, in the example of FIG. 1, the outer edges of the first piston are shaped, for instance by machining, so that a good support is formed for one end of the first resilient means 9 in the way shown in the figure. The second end of the body 2, where the second channel 12 is located is preferably also provided with a machined support for the other end of the first resilient means 9.

The middle section of the first piston 5 forming the bottom of the cup is provided with a leading through, in which a channel construction 10 is located. The channel construction is in its simplest form a pipe. The second end of the channel construction is attached to the second end of the device. The first piston 5 is then allowed to move with respect to the channel construction, the direction of the motion being dependent on the effect of the active forces prevailing on both sides of the first piston 5. From the channel 13 (i.e. from the interior of the pipe) of the channel construction there is at least one leading through 14 (FIG. 2) to the volume of the chamber, which in this specification is called a second volume 11. The second volume 11 is a part of the chamber defined by the first piston 5 and the body 2 of the device at its second end. In the example of FIGS. 1-9 the channel construction 10 is provided with leading through holes 14 at two points in the longitudinal direction of the channel construction.

Figure 3:
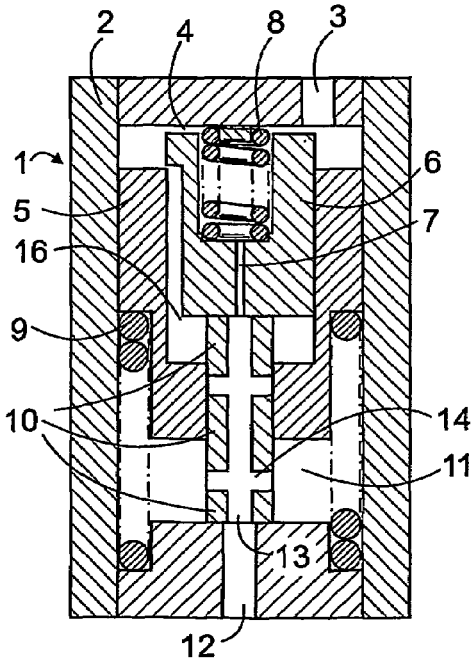
Figure 4:
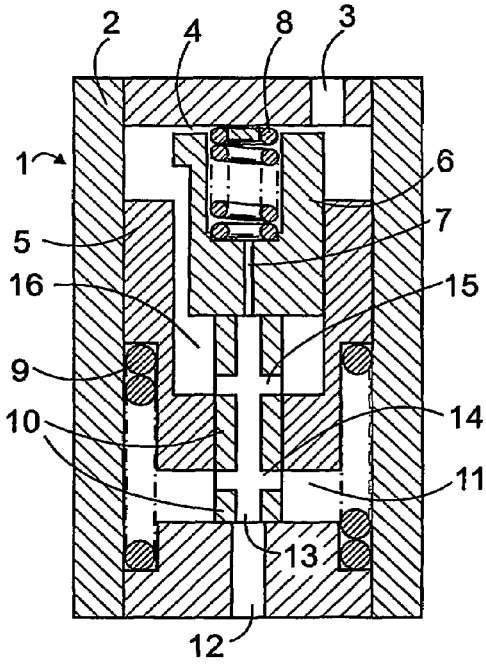

In the cup of the second piston 6 there is located a second resilient means 8, which biases the second piston toward the channel construction in the manner shown in FIG. 1. Both the first 9 and the second 8 resilient means are for instance springs. The springs are preferably helical springs. The outer edge of the second piston 6 is provided with a chamfer or groove, by means of which an auxiliary volume 16 has been provided in the device (FIGS. 3 and 4). The auxiliary volume 16 is defined by the inner edge (the edge facing the cup) of the first piston 5 and the outer edge of the second piston 6. In the operating state according to FIG. 1 the auxiliary volume is closed and its volume is at its smallest. A closed volume means in this specification that the fuel is allowed to enter the auxiliary volume through a restricted path, e.g. through the clearance between the pistons or through a separate choke channel (not shown in the figures).

In the operating state shown in FIG. 1 there is a chamber portion between the second piston 6 and the first end of the device, which portion is in this specification called a first volume or a first main volume 4. In FIG. 1 the first volume is at its smallest. In addition, the first volume is in communication with the first channel 3. There is a very narrow gap (not shown in FIG. 1) between the first end of the device and the first piston 5, which gap is also included in the first volume 4 and into which the fuel entering the device is allowed to penetrate.

The middle section of the second piston 6 (on the cup bottom) is provided with a leading through 7 from the first volume 4 to the channel 13 of the channel construction 10. The channel of the channel construction is in communication with the second channel 12 at the second end of the device either directly, as shown in FIG. 1, or through the second volume 11. The leading through 7 is a choke channel and its purpose is to allow a desired return flow of fuel to enter the other side of the piston.

The operating state of FIG. 1 may be regarded as an initial situation of the injection process (i.e. the start of the injection pressure curve). In this situation the pressure differences between the first 4 and second 11 volume are not sufficient for overcoming the pressure of the first spring 9. In a normal assembling situation the second channel 12 is connected to the feed line of the injection nozzle and the first channel to the outlet channel of the injection valve.

Figure 2:
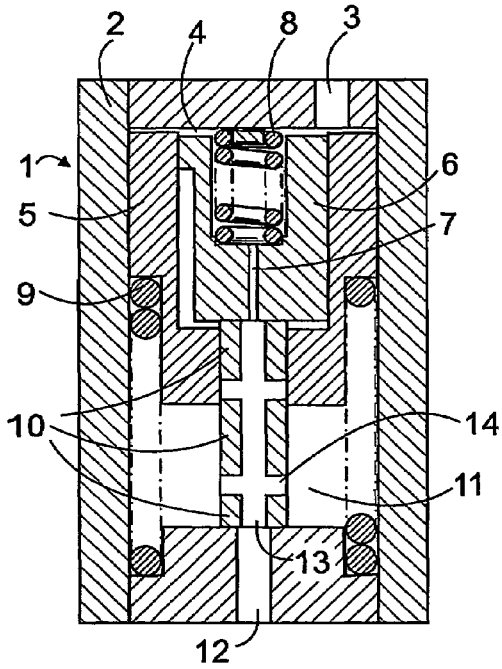

As soon as the injection commences, a pressure difference is created between the volume of the first and second channel. The pressure difference between the first volume 4 and the second volume 11 will increase sufficiently so as to press the first piston 5 against the first resilient means 9 and toward the second end of the device. The first volume 4 and the auxiliary volume 16 start increasing. The second volume 11 starts diminishing, while fuel flows into the second channel 12. FIG. 2 shows the start of the injection.

While the first piston 5 is moving toward the second end of the device, a connection between the first volume 4 and the auxiliary volume 16 is established. Then, the fuel flowing into the device through the first channel 3 starts filling not only the volume 4, but also the auxiliary volume 16. The falling pressure in the auxiliary volume starts slowing down the piston motion toward the second end, because the force biasing the piston 5 is reduced correspondingly. The pressure will fall in the auxiliary volume 16, since the volume thereof is increasing due to the piston motion and the fuel flow from the volume 4 to the auxiliary volume 16 is restricted. The effect that slows down the motion of the piston 5 due to the auxiliary volume 16 will cease, once the pressure difference between the auxiliary volume and the first volume has been balanced. FIG. 3 shows the moment, when the auxiliary volume and the first volume are united.

As soon as the first piston 5 has moved sufficiently toward the second end of the device, the leading through 15 of the channel construction being closer to the second piston 6 than to the second end of the device, establishes a connection from the auxiliary volume 16 to the channel 13 of the channel construction, through which channel the fuel is allowed to flow from the first volume and the auxiliary volume to the second channel 12 and to the second volume 11. FIG. 4 shows this operating state.

Figure 5:
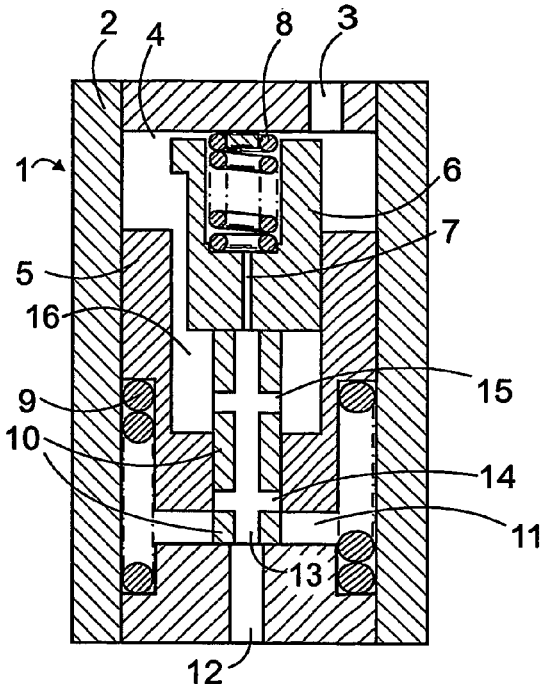

While the first piston 5 is moving further toward the second end of the device, its middle section will shut off the connection between the second volume 11 and the channel 13 of the channel construction, whereby the second volume is isolated from the environment and the fuel therein brakes the motion of the first piston 5. The motion of the first piston 5 will stop. FIG. 5 shows this moment.

Figure 6:
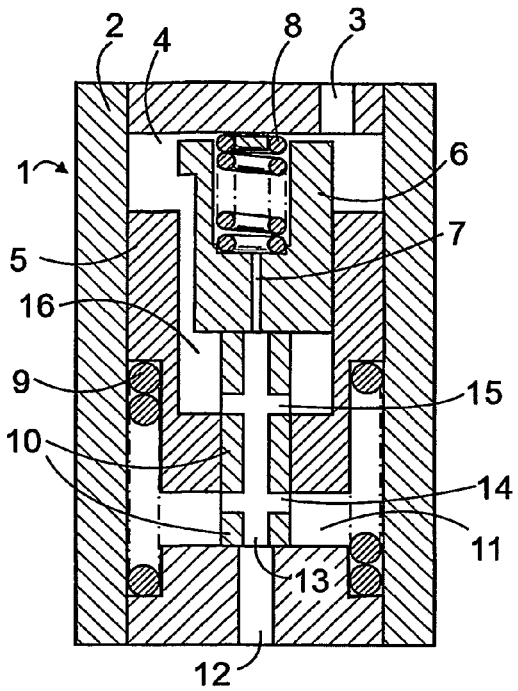

The injection is terminated and the pressure in the first channel is not higher than that in the second channel 12. The first resilient means 9 starts pressing the first piston 5 toward the first end of the device. The pressure differences between the various volumes are balanced. The fuel flows from the first volume 4 and the auxiliary volume 16 to the second volume 11. FIG. 6 shows the piston motion toward the first end of the device.

Figure 7:
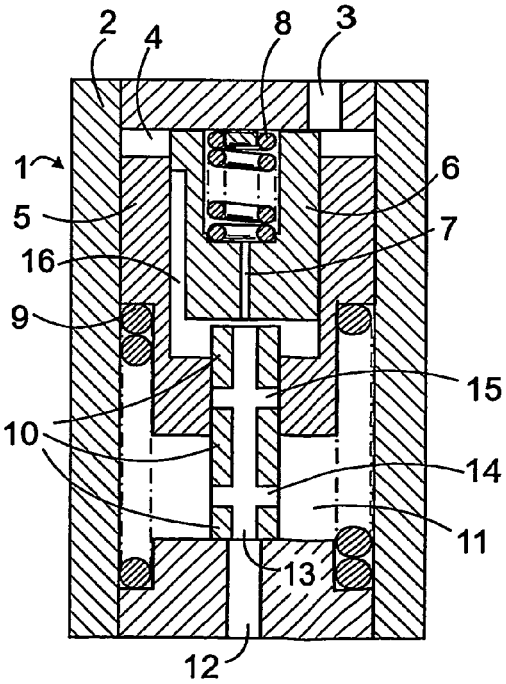
Figure 8:
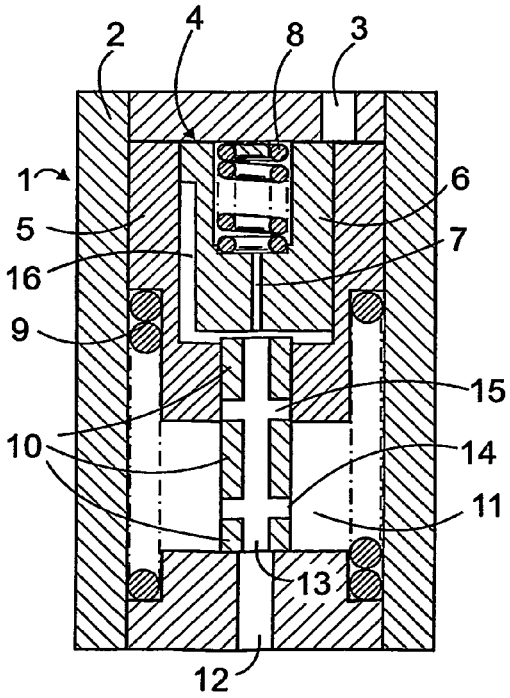
Figure 9:
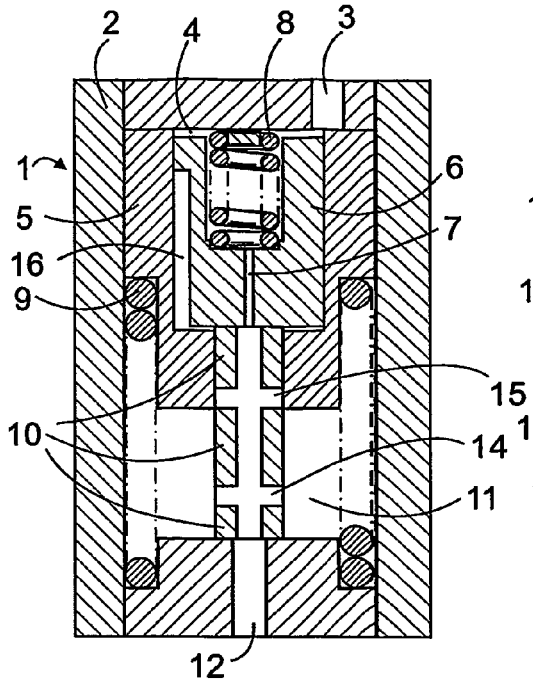

At a certain point the motion of the piston 5 will shut off the connection between the first volume 4 and the auxiliary volume 16. Since the piston is moving further, the pressure in the auxiliary volume will rise, whereby the increased pressure will finally press the second piston 6 away from the channel construction 10, when the force of the pressure is sufficient for pressing the second piston 6 toward the second resilient means 8 and the first end of the device. When the second piston 6 comes off the channel construction 10, a connection is established between the auxiliary volume 16 and the channel 13 of the channel construction, whereby the fuel in the auxiliary volume 16 is allowed to flow through the channel 13 to the second volume 11 under the action of the increased pressure and the motion of the first piston 5. This fuel flow from the auxiliary volume to the second volume will speed up the motion of the piston 5 toward the first end and toward the initial situation. FIG. 7 shows the situation, where the motion of the piston 5 toward the first end of the device shuts off the connection between the first volume 4 and the auxiliary volume 16. In FIG. 8 the first piston 5 has reached its initial state, but the second piston 6 is still away from the channel construction 10. The fuel flows from the auxiliary volume 16 to the channel 13 of the channel construction. Once the pressure has fallen sufficiently in the auxiliary volume, the second resilient means 8 will bias the second piston 6 so as to abut onto the channel construction 10. FIG. 9 corresponds to FIG. 1.

In the example shown in FIGS. 1-9 the rate of the fuel flowing to the nozzle is shaped and the pistons of the device according to the example return quickly to their initial position, which enables the start of next injection faster than in the prior art solutions. Moreover, the maximum point of the injection pressure curve can be transferred to a later moment of time, which affects the quantity and quality of the combustion gases generated by the combustion process by cutting down the production of detrimental compounds. Thus, it is often desirable to be able to restrict the mass flow of the fuel right in the beginning of the injection. This is achieved, if the injection pressure is reduced at the start of the injection.

FIGS. 10-18 show an example of another embodiment 101 according to the invention in its various operating states.

The body 102 of the device according to the figures defines a chamber, with which a first channel 103 and a second channel 1012 of the device are connected. Within the chamber a first piston 105 and a second piston 106 of the device are arranged. A first resilient means 109 biases the first piston 105 toward the first end of the device, where the first channel 103 is located.

Both the first piston 105 and the second piston 106 are cup-shaped comprising a cup. In its simplest form the first piston 105 is a cylindrical piece, in which a recess (a recess for the cup) is bored. The second piston 106 is located in the recess, i.e. in the cup, of the first piston. The cups of both pistons open toward the first end of the device.

The outer edges of the first piston 105 abut onto the body 102 of the device. Moreover, in the example of FIG. 10, the outer edges of the first piston are shaped, for instance by machining, so that a good support is formed for one end of the first resilient means 109 in the way shown in the figure. The second end of the body 102, where the second channel 1012 is located is preferably also provided with a machined support for the other end of the first resilient means 109.

The middle section of the first piston 105 forming the bottom of the cup is provided with a leading through, in which a channel construction 1010 is located. The channel construction is in its simplest form a pipe. The second end of the channel construction is attached to the second end of the device. The first piston 105 is then allowed to move with respect to the channel construction, the direction of the motion being dependent on the effect of the active forces prevailing on both sides of the first piston. From the channel 1014 (i.e. from the interior of the pipe) of the channel construction there is at least one leading through 1013 (FIG. 2) to the volume of the chamber, which in this specification is called a second volume 1011. The second volume 1011 is a part of the chamber defined by the first piston 105 and the body 102 of the device at its second end. In the example of FIGS. 10-18 the channel construction 1010 is provided with leading through holes 1013 at one point in the longitudinal direction of the channel construction 1010.

Figure 10:
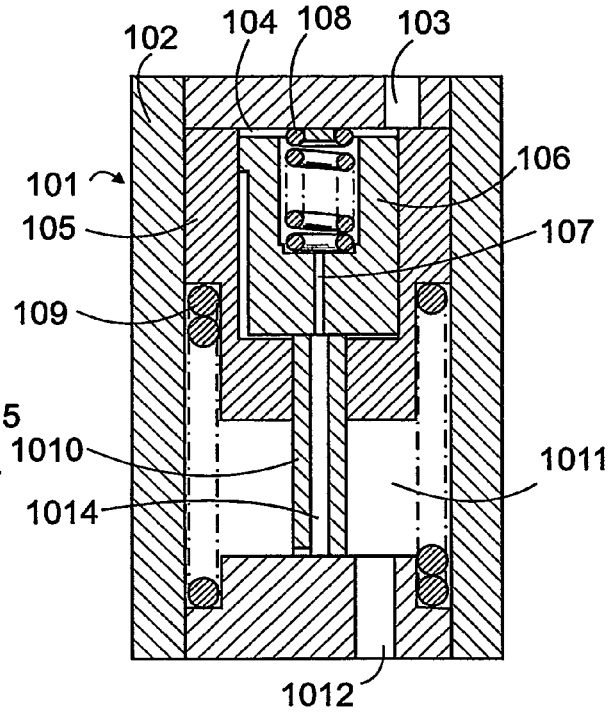
FIGS. 10-18 show an example of another embodiment according to the invention in its various operating states.

In the cup of the second piston 106 there is located a second resilient means 108, which biases the second piston toward the channel construction 1010 in the manner shown in FIG. 10. Both the first 109 and the second 108 resilient means are for instance springs. The springs are preferably helical springs. The outer edge of the second piston 106 is provided with a chamfer/groove, by means of which the auxiliary volume 1016 has been provided in the device. The auxiliary volume is defined by the inner edge (the edge facing the cup) of the first piston 105 and the outer edge of the second piston 106. In the operating state according to FIG. 10 the auxiliary volume 1016 is closed (i.e. the fuel inflow into and the outflow from the volume are restricted) and its volume is at its smallest.

In the operating state shown in FIG. 10 there is a chamber portion between the second piston 106 and the first end of the device, which portion is in this specification called a first volume or a first main volume 104. In FIG. 10 the first volume is at its smallest. In addition, the first volume is in communication with the first channel 103. There is a very narrow gap (not shown in FIG. 10) between the first end of the device and the first piston 105, which gap is also included in the first volume 104 and into which the fuel entering the device is allowed to penetrate.

The middle section of the second piston 106 (on the cup bottom) is provided with a leading through 107 from the first volume 104 to the channel 1014 of the channel construction 1010. The channel of the channel construction is in communication with the second channel 1012 at the second end of the device either directly or through the second volume 1011, as shown in FIG. 10. The leading through 107 is a choke channel and its purpose is to allow a desired return flow of fuel to enter the other side of the piston.

The operating state according to FIG. 10 may be regarded as an initial situation of the injection process (i.e. the start of the injection pressure curve). In this situation the pressure differences between the first 104 and second 1011 volume are not sufficient for overcoming the pressure of the first spring 109. In a normal assembling situation the second channel 1012 is connected to the feed line of the injection nozzle and the first channel 103 to the pressure accumulator.

The device in FIGS. 10-18 differs from the embodiment in FIGS. 1-9 in that the channel construction 1010 is only at one point in the longitudinal direction of the channel construction provided with at least one leading through 1013 to the second volume 1011, and the second channel 1012 is in direct communication with the second volume 1011. By this construction it is possible to make the device work also as a flow fuse, whereby it can shut off the fuel flow from the first channel 103 to the second channel 1012. In other respects the operation of the device corresponds that of the first embodiment (the device shown in FIGS. 1-9).

Figure 11:
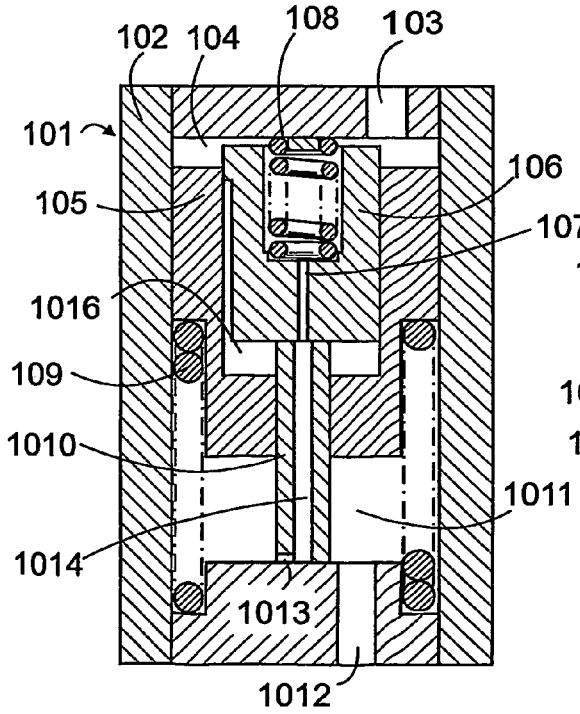
Figure 12:
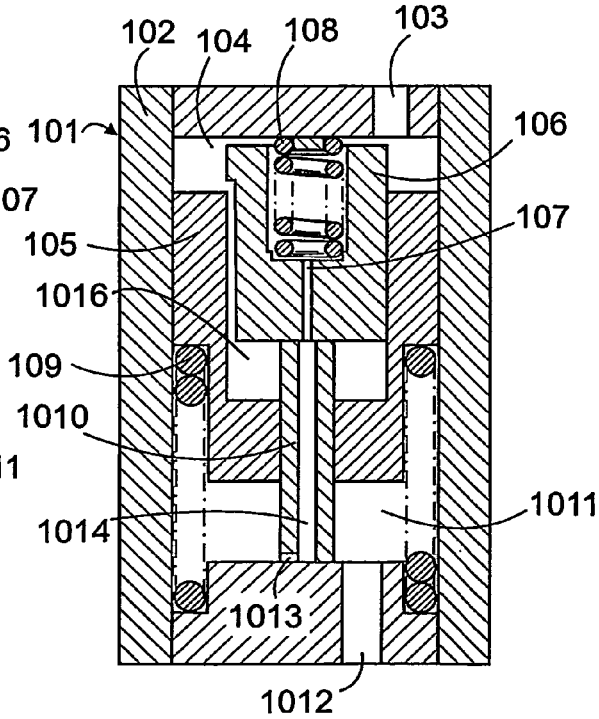
Figure 13:
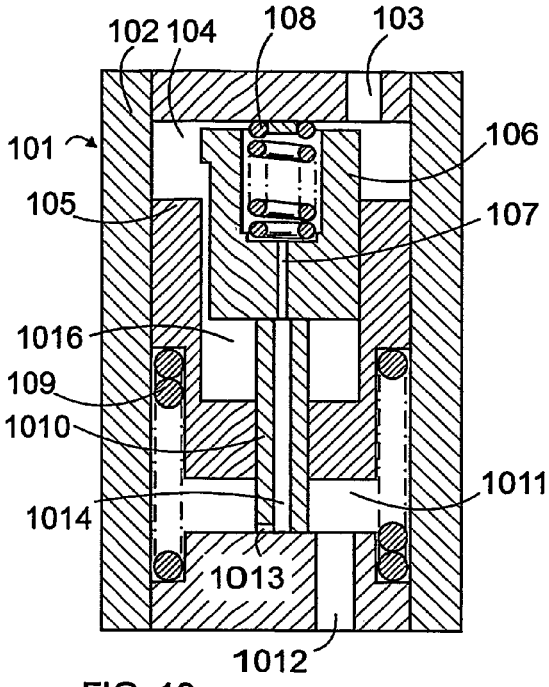
Figure 14:
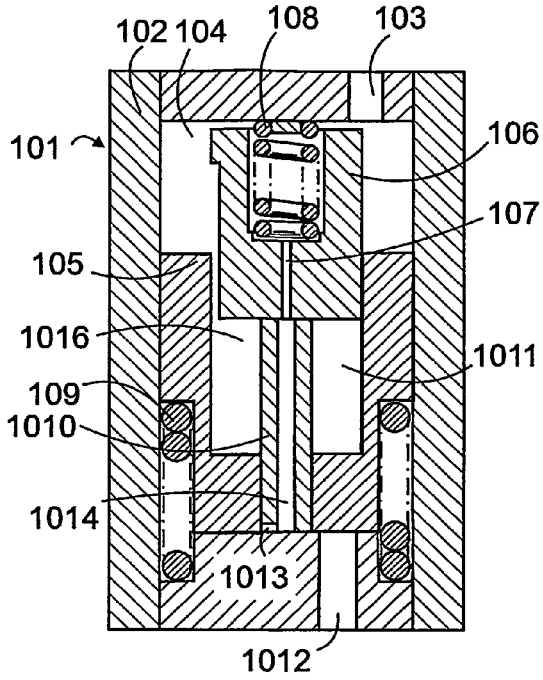
Figure 15:
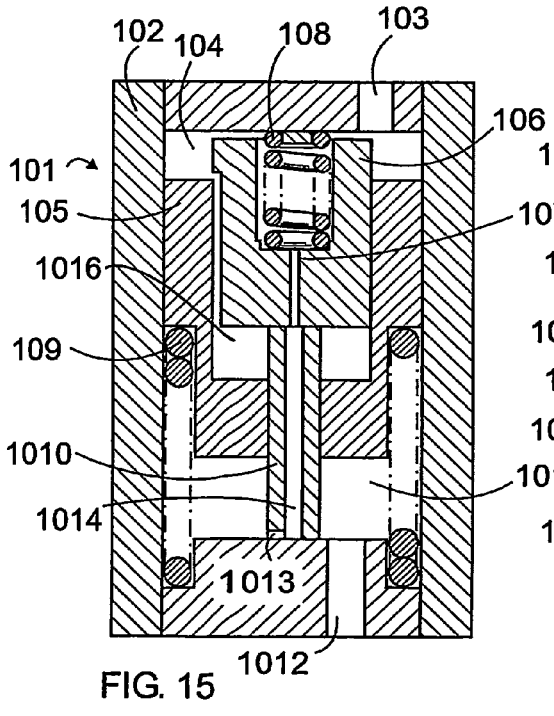
Figure 16:
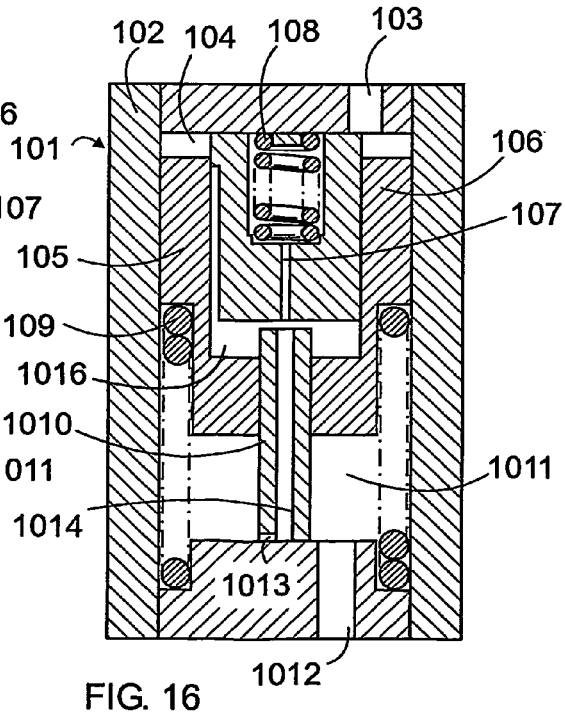
Figure 17:
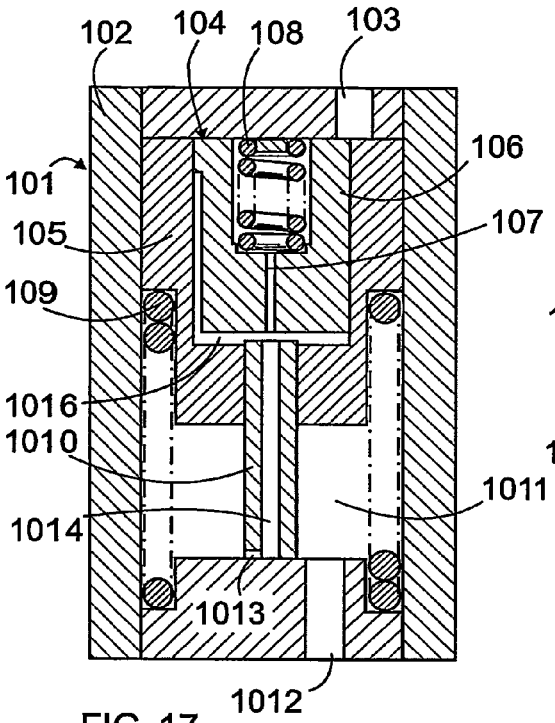
Figure 18:
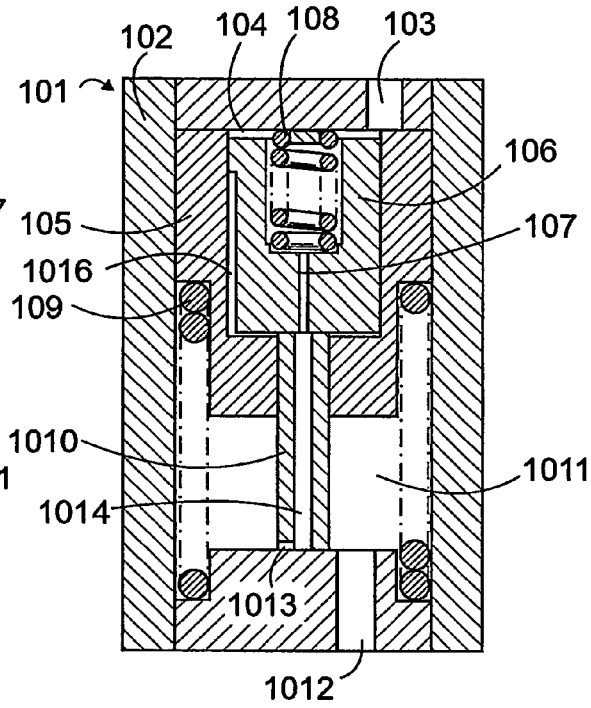

Thus, FIG. 10 shows the initial situation, FIG. 11 the start of the injection; FIG. 12 the moment after the start, when a connection between the first volume 104 and the auxiliary volume 106 has been established; FIG. 13 the motion of the first piston 109 toward the second end of the device and the diminishing of the second volume; FIG. 14 the position of the piston at the second end of the device; FIG. 15 the motion of the first piston 109 toward the first end of the device pressed by the first resilient means 109 after the injection has been terminated; FIG. 16 the situation slightly after the piston motion toward the first end of the device has shut off the connection between the first volume 104 and the auxiliary volume 1016 and the second piston 106 has come off the channel construction 1010; FIG. 17 the situation, where the first piston 105 has returned to its initial position and the second piston 106 is still away from the channel construction 1010; and FIG. 18 the initial position, i.e. the state in FIG. 10. It is to be noted that in FIG. 14 the first piston 105 shuts off the connection between the channel 1014 of the channel construction and the second volume 1011.

The example in FIGS. 10-18, as also the embodiment in FIGS. 1-9, shapes the rate of the fuel flowing to the nozzle. The pistons of the device according to the example return at the end of the injection faster to the initial position, which enables the start of next injection earlier than in the prior art solutions. Moreover, the maximum point of the injection pressure curve can be transferred to a later moment of time, which affects the quantity and quality of the combustion gases generated by the combustion process by decreasing the production of detrimental compounds. The flow fuse operation is accomplished, when the first piston 105 is situated at the second end of the device, whereby it shuts off the connection provided by the leading through 1013 to the second volume 1011, through which path the fuel could flow to the second channel.

Figure 19:
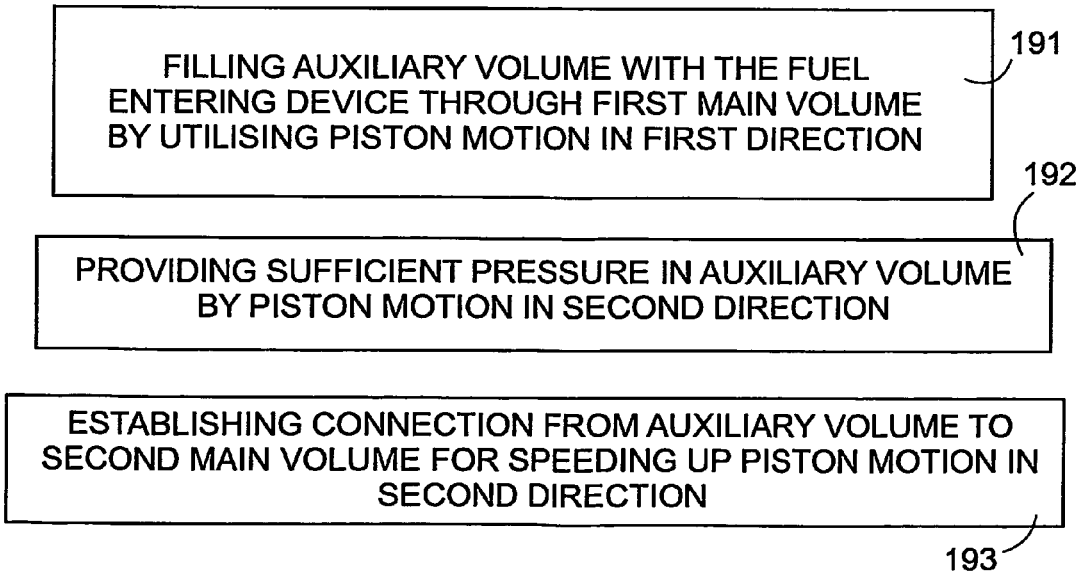
FIG. 19 shows an exemplary flow diagram illustrating the method according to the invention.

FIG. 19 shows as an exemplary flow diagram illustrating the method for the device for fuel injection rate shaping. As mentioned earlier, the basic embodiment of the device according to the invention comprises a chamber and a movable piston arranged therein and dividing the chamber into a first and second main volume, the volumes of which depend upon the position of the piston, and at least one auxiliary volume, which can be united with the main volumes. According to the method the auxiliary volume is filled 191 with the fuel entering the device through the first main volume by utilising the piston motion in the first direction, i.e. toward the second end of the device (the start and duration of the injection). At a certain moment, when the piston is at a specific point, a sufficient pressure is provided 192 in the auxiliary volume by the piston motion in the second direction (toward the first end after the injection has stopped). By means of the sufficient pressure and the continuous motion of the piston a connection between the auxiliary volume and the second main volume is established 193 for speeding up the piston motion in the second direction, whereby a fuel flow from the auxiliary volume to the second main volume is allowed.

The filling of the auxiliary volume with fuel is arranged so that the connection between the auxiliary volume and the first main volume is established at a certain piston position while the piston is moving in the first direction. It is advantageous that the connection between the auxiliary volume and the first main volume is established at the initial moments, when the piston starts its motion in the first direction. In this manner the maximum of the injection pressure curve can be transferred to a later moment. From a constructional point of view it is possible to arrange the timing also so that the connection from the auxiliary volume to the second main volume is established at a certain piston position while the piston is moving in the second direction, i.e. toward the first end of the device, where the first channel is located.

The areas of both pistons in the embodiments of the figures are dimensioned so that at the start of the injection a desired pressure reduction is accomplished between the first channel and the second channel. When the pressure in the second volume 11, 1011 is sufficiently lower than that in the first channel 3, 103, the motion of the first piston 5, 105 is toward the second end of the device, which motion increases the first volume 4, 104 defined by the body and the pistons at the first end of the device, and at a certain position of the first piston unites the first volume with the auxiliary volume 16, 1016.

When the pressure in the second volume 16, 1016 is sufficiently high compared with the pressure prevailing within the first channel 3, 103, the motion of the first piston 5, 105 is toward the first end of the device assisted by the first resilient means 9, 109, which motion diminishes the auxiliary volume 16, 1016 and the first volume 4, 104, and at a certain position of the first piston breaks the communication between the first volume and the auxiliary volume. Due to the broken communication the pressure in the auxiliary volume makes the second piston move 6, 106 toward the first end of the device disconnecting the second piston 6, 106 from the channel construction 10, 1010, whereby a connection between the auxiliary volume and the channel 13, 1014 of the channel construction is established. While the pressure is falling in the auxiliary volume 16, 1016, the second resilient means 8, 108 assists the second piston 6, 106 toward the channel construction breaking the communication between the auxiliary volume 16, 1016 and the channel 13, 1014 of the channel construction.

As mentioned earlier, the basic embodiment of the device according to the invention comprises a chamber arranged in the body thereof, a first channel at the first end of the device for the fuel primarily entering the device and a second channel at the second end of the device for the fuel primarily leaving the device, the first and second channel being in communication with the chamber, into which chamber a movable first piston is arranged dividing the chamber into a first main volume and a second main volume, the volumes of which depend upon the position of the piston. Further, the device according to the invention comprises at least one auxiliary volume, which can be united with the main volumes.

The auxiliary volume can be filled with the fuel entering the device through the first main volume by utilising the piston motion in the first direction (direction of motion at the start of the injection), whereby by utilising the piston motion in the second direction (direction of motion after the injection has been terminated) a desired pressure can be reached in the auxiliary volume and by establishing a connection from the auxiliary volume to the second main volume, whereby a fuel flow from the auxiliary volume to the second main volume is allowed, the piston motion in the second direction can be speeded up. The connections may be established and shut off between the main volumes and the auxiliary volume by means of the motion and structure of the piston and/or by various valve arrangements, which operate in a desired manner under the action of the pressure difference between the volumes. The auxiliary volume may be located for instance in the body of the device or in another suitable place. Thus, the invention may be realised by using one piston.

The embodiments described in more detail in the above (the first embodiment in FIGS. 1-9 and the second embodiment in FIGS. 10-18) show more accurately some applications for realising the invention. It appears from the figures, among other things, that the number and position of leading through holes in the channel construction may vary depending on the application. It is also apparent that by positioning the second channel of the device at a desired place some desired properties are to be accomplished. Moreover, it appears that it is quite advantageous to locate the leading through holes of the pistons in the middle of the mid-section (cup bottom) of the piston. The body construction of the various applications may be provided with support structures for the resilient means, for instance for the second resilient means at the first end of the device. Also the bottom of the interior of the cup of the second piston may be provided with support structures for the second resilient means.

In the light of the above specification it is apparent that the device according to the invention may be realised in various manners. Thus the invention is not limited to the above-described examples, but it can be applied to a plurality of various embodiments within the scope of the inventive idea.

The invention claimed is:

1. A device for fuel injection rate shaping, the device having first and second ends and comprising:

a body defining an interior space, a first channel at the first end of the device for fuel primarily entering the device and a second channel at the second end of the device for fuel primarily leaving the device, the first and second channels being in communication with the interior space of the body, and a first piston movably disposed in the interior space of the body and dividing the interior space into a first main chamber and a second main chamber having respective volumes that depend upon the position of the first piston, whereby fuel entering the device through the first channel enters the first main chamber, the first piston having an outer wall defining a recess and also having a middle section formed with a passage, and the recess of the first piston being open toward the first end of the device, a first resilient means located in the second chamber to bias the first piston toward the first end of the device, a channel construction arranged so that one end thereof is supported by the second end of the device and another end is located in the passage of the first piston, whereby the first piston is slidable with respect to the channel construction, a second piston located in the recess of the first piston and slidable with respect to the first piston, the second piston being formed with a passage, and a second resilient means to bias the second piston toward said channel construction, and wherein the device defines at least one auxiliary chamber, initial movement of the first piston in a first direction unites the auxiliary chamber with the first main chamber, whereby the auxiliary chamber is filled with fuel from the first main chamber, subsequent movement of the first piston in a second direction, opposite said first direction, results in increase in pressure in the auxiliary chamber, and further movement of the first piston in the second direction establishes a connection between the auxiliary chamber and the second main chamber, permitting fuel flow from the auxiliary chamber to the second main chamber and speeding up movement of the piston in the second direction.

2. A device according to claim 1, wherein the second piston has an outer wall defining a recess and also has a middle section formed with said passage, and the recess of the second piston is open toward the first end of the device.

3. A device according to claim 1, wherein the channel construction is formed with an interior channel and with at least one passage connecting the interior channel to the second main chamber.

4. A device according to claim 3, wherein the passage of the second piston is in direct communication with the interior channel of the channel construction, the second resilient means biases the second piston against the channel construction, and the interior channel of the channel construction is in communication with the second channel.

5. A device according to claim 4, wherein the passage of the second piston is a choke channel.

6. A device according to claim 4, wherein the second piston has an outer side that confronts an inner side of the first piston, and the auxiliary chamber is formed by a chamfer or groove at the outer side of the second piston, whereby the auxiliary chamber is defined between the inner side of the first piston and the outer side of the second piston.

7. A device according to claim 2, wherein the position and motion of the first and second pistons are dependent upon pressure conditions prevailing within the device such that when the second main chamber is at a sufficiently low pressure relative to that prevailing within the first channel, the first piston moves in the first direction and the motion of the first piston increases the volume of the first chamber, and when the second chamber is at a sufficiently high pressure relative to that prevailing within the first channel, the first piston moves in the second direction, assisted by the first resilient means, and the motion of the first piston decreases the respective volumes of the auxiliary chamber and the first main chamber and at a certain point of the piston motion the connection between the first main chamber and the auxiliary chamber is broken and pressure in the auxiliary chamber urges the second piston in the second direction, separating the second piston from the channel construction, whereby a connection between the auxiliary chamber and the interior channel of the channel construction is established, and when the pressure in the auxiliary chamber falls, the second resilient means moves the second piston toward the channel construction, breaking the connection between the auxiliary chamber and the interior channel of the channel construction.

8. A device according to claim 6, wherein the position and motion of the first and second pistons are dependent upon pressure conditions prevailing within the device such that when the second chamber is at a sufficiently low pressure relative to that in the first channel, the first piston moves in the first direction and the motion of the first piston increases the volume of the first chamber, and when the second chamber is at a sufficiently high pressure relative to that prevailing within the first channel, the first piston moves in the second direction, assisted by the first resilient means, which motion decreases the respective volumes of the auxiliary chamber and the first volume and at a certain point of the piston motion the communication between the first chamber and the auxiliary chamber is broken and pressure in the auxiliary chamber urges the second piston in the second direction, separating the second piston from the channel construction, whereby a connection between the auxiliary chamber and the interior channel of the channel construction is established, and when the pressure in the auxiliary chamber falls, the second resilient means urges the second piston toward the channel construction, breaking the connection between the auxiliary chamber and the interior channel of the channel construction.

9. A device according to claim 3, wherein the passage or passages in the channel construction are located so that the communication between the first channel and the second channel is broken when the first piston is at the second end of the device, whereby the device blocks flow between the first and second channels.

10. A device according to claim 1, wherein the second piston is provided with support structures for the second resilient means.

11. A device according to claim 10, wherein the first and second resilient means are first and second springs respectively.

* * * * *